US009878202B2

(12) United States Patent
Littell

(10) Patent No.: US 9,878,202 B2
(45) Date of Patent: Jan. 30, 2018

(54) ABDOMINAL/BACK MUSCLE EXERCISE DEVICE

(71) Applicant: Gregory Paul Littell, Alto, MI (US)

(72) Inventor: Gregory Paul Littell, Alto, MI (US)

( * ) Notice: Subject to any disclaimer, the term of this patent is extended or adjusted under 35 U.S.C. 154(b) by 0 days.

(21) Appl. No.: 15/182,284

(22) Filed: Jun. 14, 2016

(65) Prior Publication Data

US 2016/0287934 A1 Oct. 6, 2016

Related U.S. Application Data

(63) Continuation of application No. 14/840,711, filed on Aug. 31, 2015, now abandoned, which is a continuation of application No. 13/957,359, filed on Aug. 1, 2013, now Pat. No. 9,119,984.

(60) Provisional application No. 61/678,495, filed on Aug. 1, 2012.

(51) Int. Cl.

| | |
|---|---|
| ***A63B 21/068*** | (2006.01) |
| ***A63B 23/02*** | (2006.01) |
| ***A63B 26/00*** | (2006.01) |
| ***A63B 69/00*** | (2006.01) |
| ***A63B 71/02*** | (2006.01) |

(52) U.S. Cl.

CPC ..... *A63B 23/02* (2013.01); *A63B 21/068* (2013.01); *A63B 23/0211* (2013.01); *A63B 23/0233* (2013.01); *A63B 26/00* (2013.01); *A63B 69/0057* (2013.01); *A63B 2069/0062* (2013.01); *A63B 2071/027* (2013.01); *A63B 2208/0233* (2013.01); *A63B 2225/09* (2013.01)

(58) Field of Classification Search

CPC ..... A63B 21/0047–21/00054; A63B 21/078; A63B 21/4029–21/4031; A63B 23/0205–23/0211

See application file for complete search history.

(56) References Cited

U.S. PATENT DOCUMENTS

| | | | | |
|---|---|---|---|---|
| 6,692,418 | B2 * | 2/2004 | Shahan | A63B 23/02 482/143 |
| 2007/0225135 | A1 * | 9/2007 | Webber | A63B 23/02 482/140 |
| 2011/0039668 | A1 * | 2/2011 | McCall, Jr. | A63B 23/0205 482/142 |

* cited by examiner

*Primary Examiner* — Loan H Thanh
*Assistant Examiner* — Jennifer M Deichl
(74) *Attorney, Agent, or Firm* — Dunlap Bennett & Ludwig PLLC

(57) ABSTRACT

A stand-up abdominal/back muscle exercise device. The stand-up abdominal/back muscle exercise device may include a base, a knee support, and an ankle support. Additionally, the stand-up abdominal/back muscle exercise device may include a steady post. The ankle support may include a t-bar, a telescoping inner horizontal support shaft, a telescoping inner vertical support shaft and an ankle padding. The knee support may include a telescoping upright post, a knee support inner shaft, a knee radial pivot lock bracket, a knee cushion and an upper leg support rest.

6 Claims, 4 Drawing Sheets

ABDOMINAL/BACK MUSCLE EXERCISE DEVICE

CROSS-REFERENCE TO RELATED APPLICATION

This application is a Continuation of U.S. patent application Ser. No. 14/840,711, filed on Aug. 31, 2015, which is a Continuation of U.S. patent application Ser. No. 13/957,359, filed on Aug. 1, 2013, which claims the benefit of priority of U.S. Provisional Application No. 61/678,495, filed on Aug. 1, 2012, the contents of which are herein incorporated by reference.

BACKGROUND OF THE INVENTION

The present invention relates to exercise devices and, more particularly, to stand-up abdominal and back muscles exercise devices.

Currently, lower back muscle pain caused by muscle strain is a leading factor in patients seeking relief at physical therapy. This may end up being expensive and time consuming. Most exercises that involve the abdominal or back involve getting on the floor which may aggravate the lower back as much as doing the exercise to relieve the pain. A floor is difficult to exercise properly on because of inadequate foot anchors and causes friction on the contact areas. If only doing a few quick reps, with improper clothing, an individual may have removed skin causing an extended stoppage because of the resulting discomfort. These exercises and exercise devices also tend to do too much of the work for the operator without strengthening the muscles, and result in loss of interest from lack of effectiveness.

As can be seen, there is a need for a stand-up abdominal/back muscle exercise device that may be gentle on the muscles, simple to start and effective using the operator's own weight.

SUMMARY OF THE INVENTION

In one aspect of the present invention, a stand-up abdominal/back muscle exercise device that comprises base; an ankle support attached to the base comprising; a t-bar having a vertical portion, a horizontal portion, a vertical axis, a horizontal axis, an internal housing, at least one horizontal t-bar hole and at least one vertical t-bar hole; a telescoping inner horizontal support shaft having a cross bar section and at least one inner horizontal support hole and an inner vertical support shaft having at least one inner vertical support hole within the internal housing of the t-bar; an ankle padding connected to the cross bar section of the telescoping inner horizontal support shaft; a horizontal ankle lock pin removably inserted into the at least one inner horizontal support hole and at least one horizontal t-bar hole; a vertical ankle lock pin removably inserted into the at least one inner vertical support hole and at least one vertical t-bar hole; and a knee support attached to the base comprising; a telescoping upright post having a top end, an interior housing and at least one vertical knee hole; a knee support inner shaft having have at least one inner shaft hole within the internal housing of the telescoping upright post; a pivot lock pin removably inserted into the at least one inner shaft hole of the knee support inner shaft and the at least one vertical knee hole of the telescoping upright post; a knee radial pivot lock bracket having an outer side with at least one pivot lock hole, an inner side and a top edge, wherein the knee radial pivot lock bracket is attached to the top end of the telescoping upright post; a pivot lock pin removably inserted in to the at least one pivot lock hole of the knee radial pivot lock bracket; knee cushion padding extended out from the inner side of the knee radial pivot lock bracket; and an upper leg support rest attached to the top edge of the knee radial pivot lock.

In another aspect of the present invention, a method for exercising abdominal and back muscles using a stand-up abdominal/back muscle exercise device comprising the steps of; stepping onto a base of the stand-up abdominal/back muscle exercise device; adjusting the vertical height of a knee support of the stand-up abdominal/back muscle exercise device, the knee support defined by a telescoping upright post, a knee support inner shaft, a knee radial pivot lock bracket, a knee cushion padding and an upper leg support rest; adjusting the radial degree of the knee radial pivot lock bracket in order to present the upper leg support rest in the desired position; adjusting the vertical height of an ankle support of the stand-up abdominal/back muscle exercise device, the ankle support defined by a t-bar, a telescoping inner horizontal support shaft, a telescoping inner vertical support shaft, and an ankle padding; adjusting the horizontal height of the ankle support in order to present the ankle support in the desired position; stepping in front of the knee support and behind the ankle support; leaning backward and forward with upper legs supported by the upper leg support and ankles secured by the ankle support.

These and other features, aspects and advantages of the present invention will become better understood with reference to the following drawings, description and claims.

DETAILED DESCRIPTION OF THE INVENTION

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

Broadly, an embodiment of the present invention provides a stand-up abdominal/back muscle exercise device. The stand-up abdominal/back muscle exercise device may include a base, a knee support, and an ankle support. Additionally, the stand-up abdominal/back muscle exercise device may include a steady post. The ankle support may include a t-bar, a telescoping inner horizontal support shaft, a telescoping inner vertical support shaft and an ankle padding. The knee support may include a telescoping upright post, a knee support inner shaft, a knee radial pivot lock bracket, a knee cushion and an upper leg support rest.

Figure 1A:
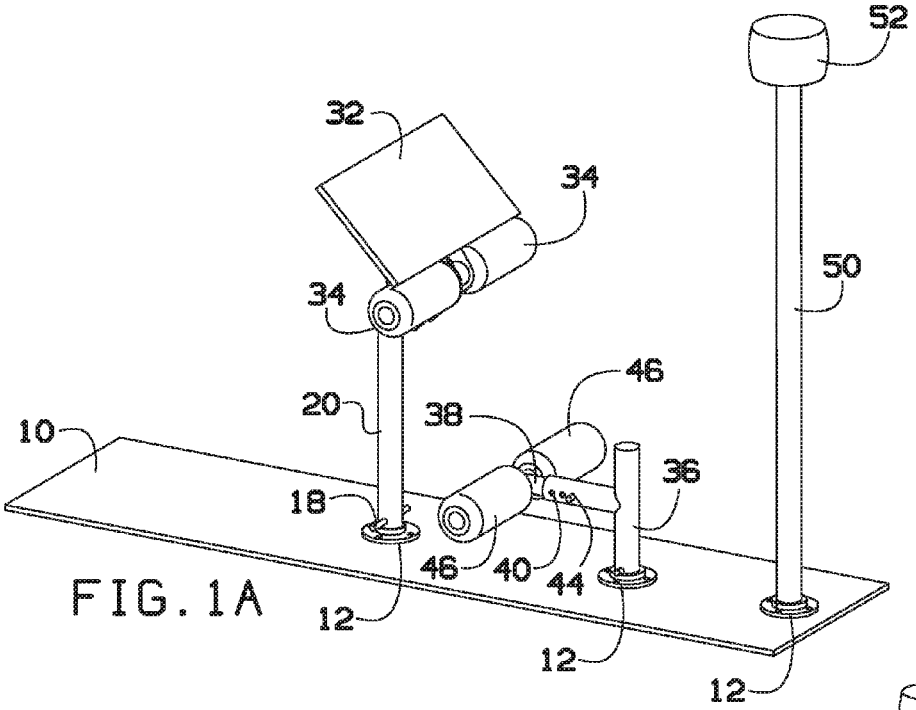
FIG. 1A is a front perspective view of an exemplary embodiment of the present invention.
Figure 1B:
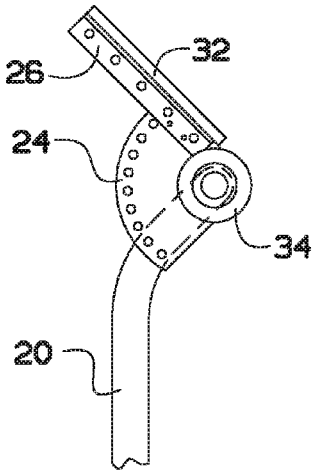
FIG. 1B is a side detail view of an exemplary embodiment of the present invention.
Figure 2:
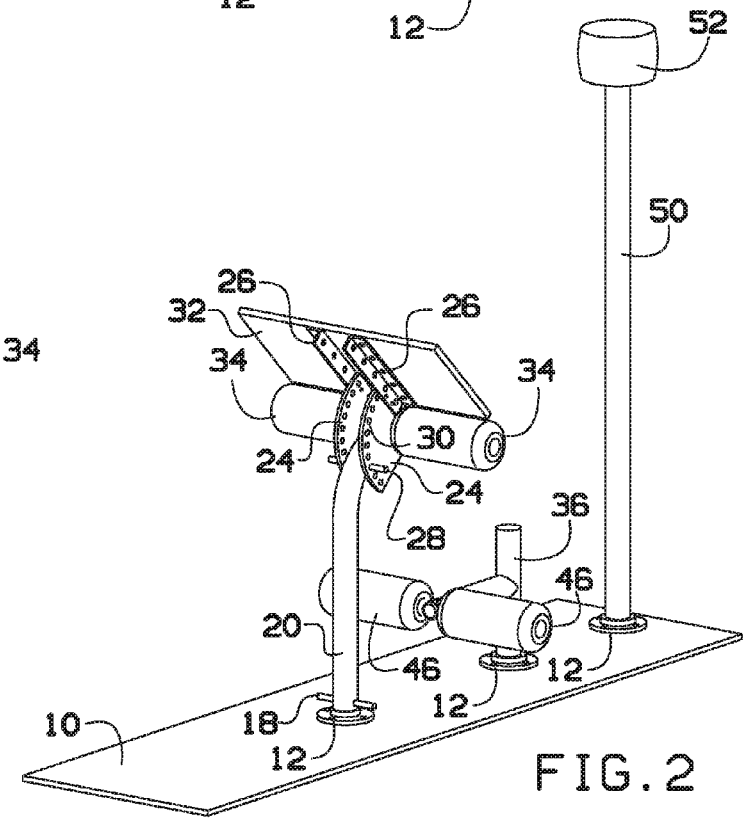
FIG. 2 is a rear perspective view of an exemplary embodiment of the present invention.
Figure 3:
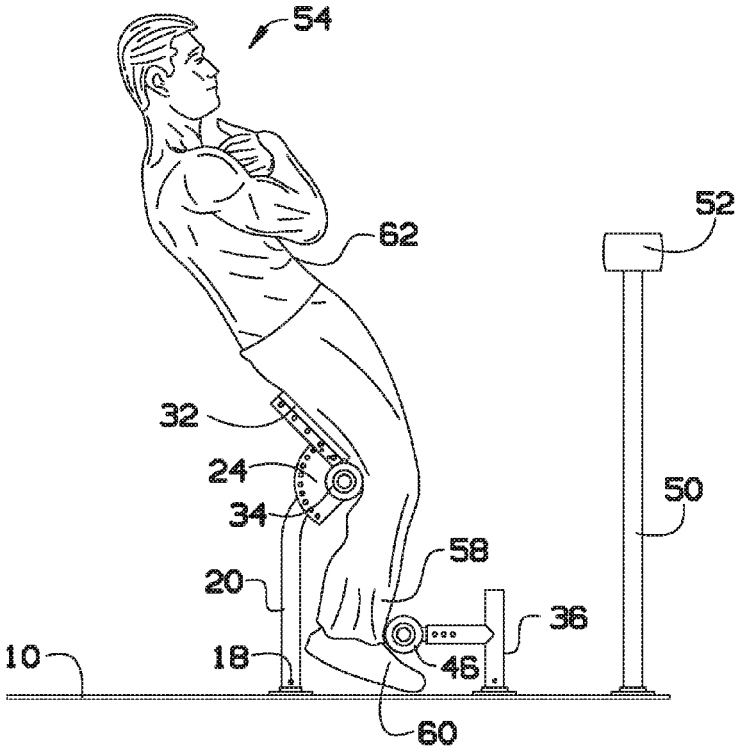
FIG. 3 is a side view of an exemplary embodiment of the present invention in use demonstrating operator 54 in lean-back configuration.
Figure 4:
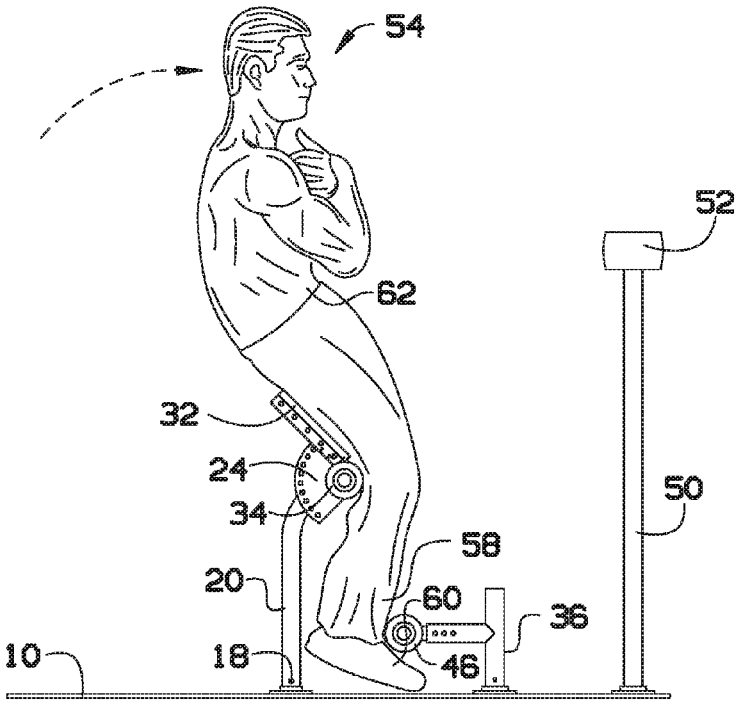
FIG. 4 is a side view of an exemplary embodiment of the present invention in use demonstrating operator 54 in lean-forward configuration.
Figure 5:
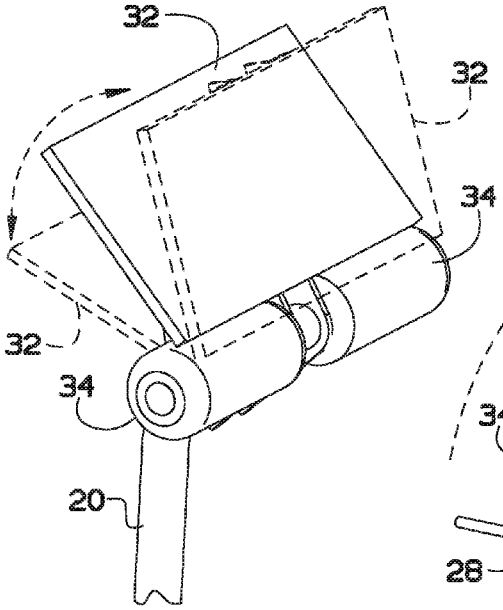
FIG. 5 is a forward perspective detail view of an exemplary embodiment of the present invention demonstrating rotational motion of item 32 seat and associated components.
Figure 6:
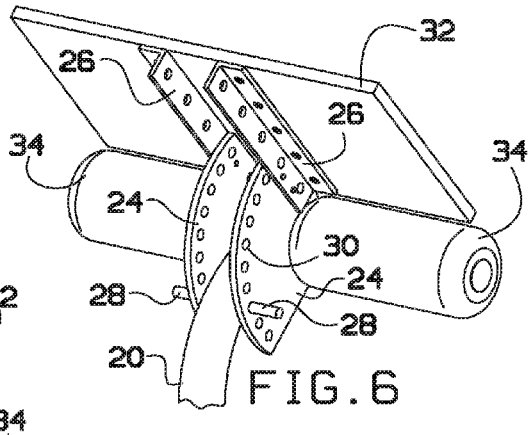
FIG. 6 is a rear perspective detail view of an exemplary embodiment of the present invention demonstrating a configuration of item 32 seat and associated components.
Figure 7:
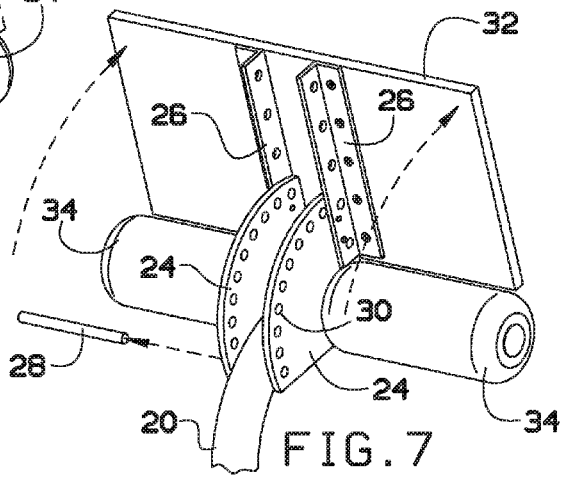
FIG. 7 is a rear perspective detail view of an exemplary embodiment of the present invention demonstrating reorientation of item 32 seat and associated components.
Figure 8:
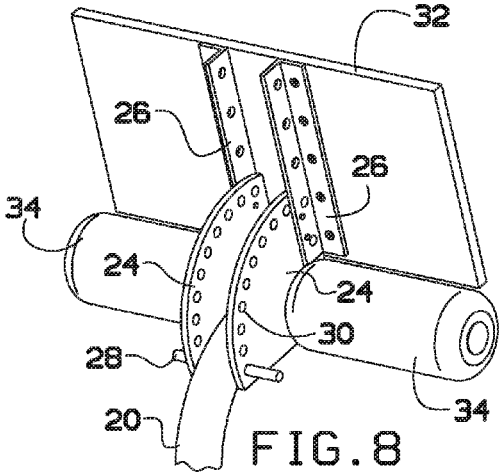
FIG. 8 is a rear perspective detail view of an exemplary embodiment of the present invention demonstrating final reoriented configuration of item 32 seat and associated components.
Figure 9:
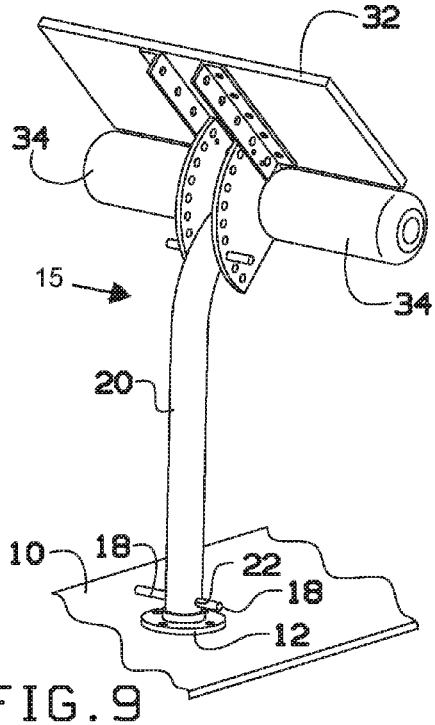
FIG. 9 is a rear perspective detail view of an exemplary embodiment of the present invention demonstrating a configuration of item 32 seat and associated components.
Figure 10:
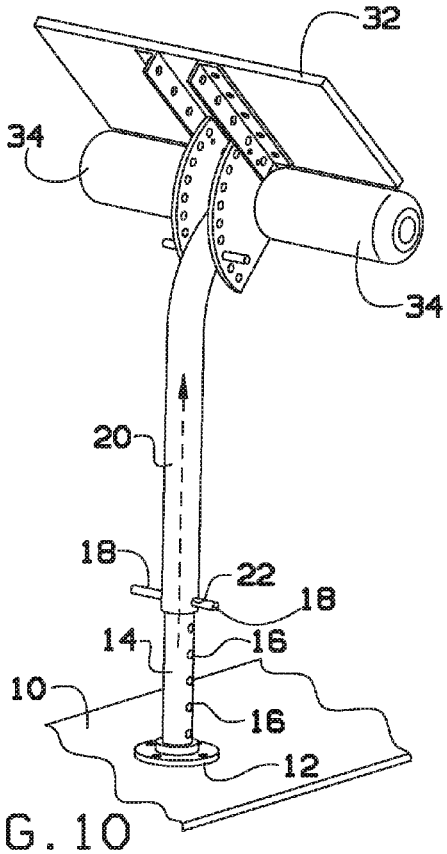
FIG. 10 is a rear perspective detail view of an exemplary embodiment of the invention demonstrating final reoriented configuration of item 32 seat and associated components.
Figure 11:
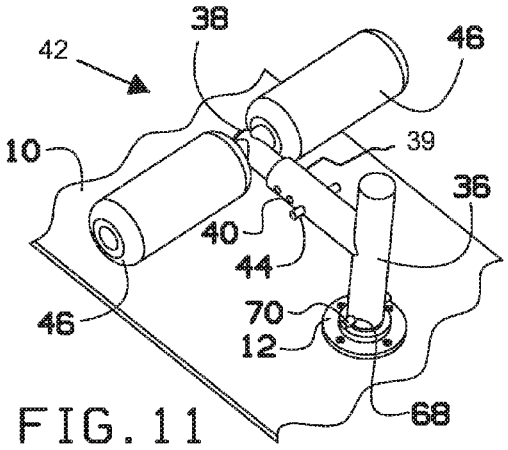
FIG. 11 is a front perspective detail view of an exemplary embodiment of the present invention demonstrating a configuration of item 38 telescoping inner ankle support shaft and associated components.
Figure 12:
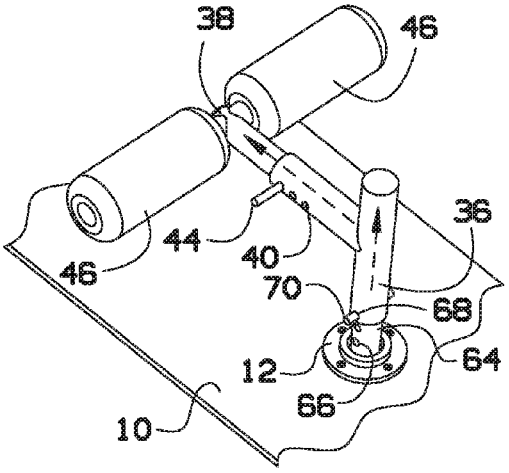
FIG. 12 is a rear front detail view of an exemplary embodiment of the present invention demonstrating final reoriented configuration of item 38 telescoping inner ankle support shaft and associated components.

Referring now to FIGS. 1A through 12, a stand-up abdominal/back muscle exercise device according to an exemplary embodiment of the present invention may include a base 10 having a first end and a second end. Attached to the base 10 may be an upright collar 12 in at least three different locations. Each upright collar 12 may help support the various components of the present device. The first end of the base 10 may have a steady post 50. The steady post 50 may have a cap 52 on top. The steady post 50 may be attached to and secured in place by an upright collar 12. Moving towards the second end of the base 10, there may be an ankle support, followed by a knee support.

In certain embodiments, the ankle support may include a t-bar 36 connected to an upright collar 12. The t-bar 36 may have a vertical portion and a horizontal portion, a vertical axis and a horizontal axis and an internal housing. There may be both a telescoping inner horizontal support shaft 38 and an inner vertical support shaft 64. The telescoping inner horizontal support shaft 38 may also be in a "t" shape with a base 10 that extends out from the internal housing of the t-bar 36 and a cross bar section perpendicular from the base 10. The telescoping inner horizontal support shaft 38 may be within the internal housing of the horizontal portion of the t-bar 36 and may have at least one inner horizontal support hole 39. The inner vertical support shaft 64 may be within the internal housing of the vertical portion of the t-bar 36. The inner vertical support shaft 64 may have at least one inner vertical support hole 66. On the end of the horizontal portion of the t-bar 36 may be at least one horizontal t-bar hole 40. The at least one horizontal t-bar hole 40 may be provided so that a horizontal ankle lock pin 44 may be inserted to lock the telescoping inner horizontal support shaft 38 into a specific position along the horizontal axis of the t-bar 36. On the end of the vertical portion of the t-bar 36 may be at least one vertical t-bar hole 68. The at least one vertical t-bar hole 68 and at least one inner vertical support hole 66 may be provided so that a vertical ankle lock pin 70 may be inserted to lock the inner vertical support shaft 64 into a specific position along the vertical axis of the t-bar 36. Along the cross bar section of the telescoping inner horizontal support shaft 38 may be ankle padding 46.

In certain embodiments, the knee support may include a telescoping upright post 20 having an interior housing and at least one vertical knee hole 22, a knee radial pivot lock bracket 24 having an outer side, an inner side and a top edge, knee padding and upper leg support rest 32. The telescoping upright post 20 having a top end may be connected to an upright collar 12. A knee support inner shaft 14 may be within the internal housing of the telescoping upright post 20. The knee support inner shaft 14 may have at least one inner shaft hole 16. The at least one inner shaft hole 16 and at least one vertical knee hole 22 may be provided so that a knee lock pin 18 may be inserted to lock the telescoping upright post 20 into a specific position along the knee support inner shaft 14. The knee radial pivot lock bracket 24 attaches to and extends from the top end of the telescoping upright post 20. At least one pivot lock hole 30 may be included along the outer side of the knee radial pivot lock bracket 24. A pivot lock pin 28 may be placed in the at least one pivot lock hole 30 to secure the knee support in a particular radial position. Extending out from the inner side of the knee radial pivot lock bracket 24 may be knee cushion padding 34. Attached to the top edge of the knee radial pivot lock bracket 24 may be at least one "L" bracket rail 26 having a lower portion and an upper portion. Attached to the upper portion of the "L" bracket may be an upper leg support rest 32. The upper leg support rest 32 may be a flat plate.

An operator 54 may not be required to wear special clothing for a workout. The stand-up abdominal/back muscle exercise device allows for an individual to simply step onto the device and start by leaning back. The stand-up abdominal muscle exercise device may hold the operator's lower legs vertically, while the upper leg support may hold the desired angle while leaving the hips with total freedom of movement.

The stand-up abdominal/back muscle exercise device design may be of various sizes and shapes as long as the base 10 secures the ankle support and the knee support in their proper positions, allow an operator to adjust the components and be durable and safe for use. In alternate embodiments the telescoping upright post 20 may be in a three point stance to allow for a more balanced weight carrying on the base 10. Materials used for the stand-up abdominal muscle exercise device may vary. The ankle padding 46 and the knee cushion padding 34 may be made from a material that may be durable with use such as a polymer such as vinyl, plastic and the like.

A method of using a stand-up abdominal/back muscle exercise device may include the following. Once assembled, the operator may stand on the base 10 placing their legs behind the ankle support and in front of the knee support. The operator's feet 60 may be under the ankle padding 46. The operator may adjust the knee padding to a position that may be a comfortable point behind the knee for bending and adjust the ankle padding 46 at or above the operator's ankle 58 for vertical stability. The operator may then adjust the upper leg support. The upper leg support should be positioned so that the upper leg support rest 32 just below the operator's buttocks. The operator's torso weight 62 may be supported only by the abdominal and lower back muscles. The operator may do a semi-vertical sit-up/crunch without having to get on the floor or bench working from a horizontal or sitting position. A steady post 50 may be used to help when positioning, or during breaks to help coming back to a full upright position. The steady post 50 may also be used for operators that are elderly or have over exercised.

The operator's lower back may be free from friction and pressure on sore muscles as the operator simply leans gently backward and forward, bending at the hips. The operator focuses the work on the lower back and the abdominal muscles while leaning backward and forward. This movement stretches out any knots that may be causing lower back pain along with strengthening the involved muscles at the same time. As the operator becomes stronger, the upper leg support may be lowered radially to the point where it is completely out of the way or may be easily removed. Other muscles groups that may be worked out also include neck and shoulders, laterals, legs, thighs and calves. The exercise may be effective because the muscles are being gently stretched using body weight, and as pain may be relieved, the same exercise acts to strengthen the back and abdominal muscles to prevent future back issues. The operator's weight anchors the base and at the same time positions the operator for the exercise. By leaning forward and backward gently, the operator's weight exerts tension on the lower back and abdominal muscles, stretching and strengthening them at the same time.

It should be understood, of course, that the foregoing relates to exemplary embodiments of the invention and that modifications may be made without departing from the spirit and scope of the invention as set forth in the following claims.

What is claimed is:

1. A stand-up abdominal/back muscle exercise device comprising:

a base;

an ankle support attached to the base comprising;

a t-bar having a vertical portion extending from the base and a horizontal portion;

a support shaft having a cross bar section extending from the horizontal portion of the t-bar;

a knee support attached to the base comprising;

a telescoping upright post having a top end, an interior housing and at least one vertical knee hole;

a knee support inner shaft having have at least one inner shaft hole within the internal housing of the telescoping upright post;

a pivot lock pin removably inserted into the at least one inner shaft hole of the knee support inner shaft and the at least one vertical knee hole of the telescoping upright post;

a knee radial pivot lock bracket having an outer side with at least one pivot lock hole, an inner side and a top edge, wherein the knee radial pivot lock bracket is attached to the top end of the telescoping upright post;

a pivot lock pin removably inserted in to the at least one pivot lock hole of the knee radial pivot lock bracket; and an upper leg support rest attached to the top edge of the knee radial pivot lock so that the upper leg support rest is pivotable about the top end.

2. The stand-up abdominal/back muscle exercise device of claim 1, further comprising a steady post positioned in front of the ankle support and attached to the base.

3. The stand-up abdominal/back muscle exercise device of claim 1, wherein the ankle support and the knee support attach to the base by an upright collar.

4. The stand-up abdominal/back muscle exercise device of claim 1, wherein the upper leg support rest attaches to the top edge of the knee radial pivot lock by at least one "L" bracket rail.

5. A method for exercising abdominal and back muscles using a stand-up abdominal/back muscle exercise device comprising the steps of;

stepping onto a base of the stand-up abdominal/back muscle exercise device;

adjusting the vertical height of a knee support of the stand-up abdominal/back muscle exercise device, the knee support defined by a telescoping upright post ending in a cross bar section, wherein a knee radial pivot lock bracket pivotally connects an upper leg support about the cross bar section;

adjusting the radial degree of the knee radial pivot lock bracket about the cross bar section in order to present the upper leg support rest in the desired position;

adjusting the vertical height of an ankle support of the stand-up abdominal/back muscle exercise device, the ankle support defined by a t-bar, a telescoping inner horizontal support shaft, and a telescoping inner vertical support shaft;

adjusting the horizontal height of the ankle support in order to present the ankle support in the desired position;

stepping in front of the knee support and behind the ankle support; and leaning backward and forward with upper legs supported by the upper leg support and ankles secured by the ankle support.

6. A stand-up abdominal/back muscle exercise device comprising:

a base;

an ankle support attached to the base comprising;

a t-bar having a vertical portion extending from the base and a horizontal portion;

a support shaft having a cross bar section extending from the horizontal portion of the t-bar;

a knee support attached to the base comprising;

a telescoping upright post having a top end and an interior housing;

a knee support inner shaft within the internal housing of the telescoping upright post for adjusting a vertical height of the top end;

a knee radial pivot lock bracket having an outer side, an inner side and a top edge, wherein the knee radial pivot lock bracket is attached to the top end of the telescoping upright post; and an upper leg support rest attached to the top edge of the knee radial pivot lock so that the upper leg support rest is pivotable about the top end between a rotational motion condition and a final orientation condition.

* * * * *